US010832702B2

(12) United States Patent
Lesso

(10) Patent No.: US 10,832,702 B2
(45) Date of Patent: Nov. 10, 2020

(54) ROBUSTNESS OF SPEECH PROCESSING SYSTEM AGAINST ULTRASOUND AND DOLPHIN ATTACKS

(71) Applicant: Cirrus Logic International Semiconductor Ltd., Edinburgh (GB)

(72) Inventor: John Paul Lesso, Edinburgh (GB)

(73) Assignee: Cirrus Logic, Inc., Austin, TX (US)

( * ) Notice: Subject to any disclaimer, the term of this patent is extended or adjusted under 35 U.S.C. 154(b) by 103 days.

(21) Appl. No.: 16/155,053

(22) Filed: Oct. 9, 2018

(65) Prior Publication Data

US 2019/0115046 A1 Apr. 18, 2019

Related U.S. Application Data

(60) Provisional application No. 62/571,944, filed on Oct. 13, 2017.

(30) Foreign Application Priority Data

Feb. 6, 2018 (GB) ..... 1801874.7

(51) Int. Cl.

| | |
|---|---|
| ***G10L 25/51*** | (2013.01) |
| ***G10L 25/03*** | (2013.01) |
| ***G10L 25/93*** | (2013.01) |
| ***G10L 25/60*** | (2013.01) |
| ***G10L 21/02*** | (2013.01) |

(Continued)

(52) U.S. Cl.

CPC ..... *G10L 25/93* (2013.01); *G10L 21/02* (2013.01); *G10L 25/03* (2013.01); *G10L 25/48* (2013.01); *G10L 25/60* (2013.01); *G10L 25/18* (2013.01); *G10L 25/21* (2013.01); *G10L 2025/937* (2013.01)

(58) Field of Classification Search

CPC ..... G10L 17/005; G06F 21/32

See application file for complete search history.

(56) References Cited

U.S. PATENT DOCUMENTS

| | | | |
|---|---|---|---|
| 5,197,113 | A | 3/1993 | Mumolo |
| 5,568,559 | A | 10/1996 | Makino |

(Continued)

FOREIGN PATENT DOCUMENTS

| | | | |
|---|---|---|---|
| AU | 2015202397 | B2 | 5/2015 |
| CN | 1937955 | A | 3/2007 |

(Continued)

OTHER PUBLICATIONS

Zhang et al. "DolphinAttack: Inaudible Voice Commands", Retrieved from Proceedings of the 2017 ACM SIGSAC Conference on Computer and Communications Security. Aug. 2017. (Year: 2017).*

(Continued)

*Primary Examiner* — Jialong He

(74) *Attorney, Agent, or Firm* — Jackson Walker L.L.P.

(57) ABSTRACT

A method for improving the robustness of a speech processing system having at least one speech processing module comprises: receiving an input sound signal comprising audio and non-audio frequencies; separating the input sound signal into an audio band component and a non-audio band component; and identifying possible interference within the audio band from the non-audio band component. Based on such an identification, the operation of a downstream speech processing module is adjusted.

32 Claims, 8 Drawing Sheets

(51) Int. Cl.

| | |
|---|---|
| ***G10L 25/48*** | (2013.01) |
| *G10L 25/21* | (2013.01) |
| *G10L 25/18* | (2013.01) |

(56) References Cited

U.S. PATENT DOCUMENTS

| | | | |
|---|---|---|---|
| 5,787,187 | A | 7/1998 | Bouchard et al. |
| 6,480,825 | B1 | 11/2002 | Sharma et al. |
| 7,016,833 | B2 | 3/2006 | Gable et al. |
| 7,039,951 | B1 | 5/2006 | Chaudhari et al. |
| 7,492,913 | B2 | 2/2009 | Connor et al. |
| 8,489,399 | B2 | 7/2013 | Gross |
| 8,856,541 | B1 | 10/2014 | Chaudhury et al. |
| 8,997,191 | B1 | 3/2015 | Stark et al. |
| 9,049,983 | B1 | 6/2015 | Baldwin |
| 9,171,548 | B2 | 10/2015 | Velius et al. |
| 9,305,155 | B1 | 4/2016 | Vo et al. |
| 9,317,736 | B1 | 4/2016 | Siddiqui |
| 9,390,726 | B1 | 7/2016 | Smus et al. |
| 9,430,629 | B1 | 8/2016 | Ziraknejad et al. |
| 9,484,036 | B2 | 11/2016 | Kons et al. |
| 9,548,979 | B1 | 1/2017 | Johnson et al. |
| 9,641,585 | B2 | 5/2017 | Kvaal et al. |
| 9,646,261 | B2 | 5/2017 | Agrafioti et al. |
| 9,659,562 | B2 | 5/2017 | Lovitt |
| 9,665,784 | B2 | 5/2017 | Derakhshani et al. |
| 9,984,314 | B2 | 5/2018 | Philipose et al. |
| 10,032,451 | B1 | 7/2018 | Mamkina et al. |
| 10,063,542 | B1 | 8/2018 | Kao |
| 10,079,024 | B1 | 9/2018 | Bhimanaik et al. |
| 10,097,914 | B2 | 10/2018 | Petrank |
| 10,192,553 | B1 | 1/2019 | Chenier et al. |
| 10,204,625 | B2 | 2/2019 | Mishra et al. |
| 10,210,685 | B2 | 2/2019 | Borgmeyer |
| 10,305,895 | B2 | 5/2019 | Barry et al. |
| 10,318,580 | B2 | 6/2019 | Topchy et al. |
| 10,334,350 | B2 | 6/2019 | Petrank |
| 10,460,095 | B2 | 10/2019 | Boesen |
| 10,467,509 | B2 | 11/2019 | Albadawi et al. |
| 10,733,987 | B1 | 8/2020 | Govender et al. |
| 2002/0194003 | A1 | 12/2002 | Mozer |
| 2003/0033145 | A1 | 2/2003 | Petrushin |
| 2003/0177006 | A1 | 9/2003 | Ichikawa et al. |
| 2003/0177007 | A1 | 9/2003 | Kanazawa et al. |
| 2004/0030550 | A1 | 2/2004 | Liu |
| 2004/0141418 | A1 | 7/2004 | Matsuo et al. |
| 2005/0060153 | A1 | 3/2005 | Gable et al. |
| 2005/0171774 | A1 | 8/2005 | Applebaum et al. |
| 2006/0171571 | A1 | 8/2006 | Chan et al. |
| 2007/0055517 | A1 | 3/2007 | Spector |
| 2007/0129941 | A1 | 6/2007 | Tavares |
| 2007/0185718 | A1 | 8/2007 | Di Mambro et al. |
| 2007/0233483 | A1 | 10/2007 | Kuppuswamy et al. |
| 2007/0250920 | A1 | 10/2007 | Lindsay |
| 2008/0071532 | A1 | 3/2008 | Ramakrishnan et al. |
| 2008/0082510 | A1 | 4/2008 | Wang et al. |
| 2008/0223646 | A1 | 9/2008 | White |
| 2008/0262382 | A1 | 10/2008 | Akkermans et al. |
| 2008/0285813 | A1 | 11/2008 | Holm |
| 2009/0087003 | A1 | 4/2009 | Zurek et al. |
| 2009/0105548 | A1 | 4/2009 | Bart |
| 2009/0167307 | A1 | 7/2009 | Kopp |
| 2009/0232361 | A1 | 9/2009 | Miller |
| 2009/0281809 | A1 | 11/2009 | Reuss |
| 2009/0319270 | A1 | 12/2009 | Gross |
| 2010/0004934 | A1 | 1/2010 | Hirose et al. |
| 2010/0076770 | A1 | 3/2010 | Ramaswamy |
| 2010/0204991 | A1 | 8/2010 | Ramakrishnan et al. |
| 2010/0328033 | A1 | 12/2010 | Kamei |
| 2011/0051907 | A1 | 3/2011 | Jaiswal et al. |
| 2011/0246198 | A1 | 10/2011 | Asenjo et al. |
| 2011/0276323 | A1 | 11/2011 | Seytetdinov |
| 2011/0314530 | A1 | 12/2011 | Donaldson |
| 2011/0317848 | A1* | 12/2011 | Ivanov ..... H04R 3/04 381/94.2 |
| 2012/0110341 | A1 | 5/2012 | Beigi |
| 2012/0223130 | A1 | 9/2012 | Knopp et al. |
| 2012/0224456 | A1 | 9/2012 | Visser et al. |
| 2012/0249328 | A1 | 10/2012 | Xiong |
| 2012/0323796 | A1 | 12/2012 | Udani |
| 2013/0024191 | A1 | 1/2013 | Krutsch et al. |
| 2013/0058488 | A1 | 3/2013 | Cheng et al. |
| 2013/0080167 | A1 | 3/2013 | Mozer |
| 2013/0227678 | A1 | 8/2013 | Kang |
| 2013/0247082 | A1 | 9/2013 | Wang et al. |
| 2013/0279297 | A1 | 10/2013 | Wulff et al. |
| 2013/0279724 | A1 | 10/2013 | Stafford et al. |
| 2013/0289999 | A1 | 10/2013 | Hymel |
| 2014/0059347 | A1 | 2/2014 | Dougherty et al. |
| 2014/0149117 | A1 | 5/2014 | Bakish et al. |
| 2014/0188770 | A1 | 7/2014 | Agrafioti et al. |
| 2014/0237576 | A1 | 8/2014 | Zhang et al. |
| 2014/0241597 | A1 | 8/2014 | Leite |
| 2014/0293749 | A1 | 10/2014 | Gervaise |
| 2014/0307876 | A1 | 10/2014 | Agiomyrgiannakis et al. |
| 2014/0330568 | A1 | 11/2014 | Lewis et al. |
| 2014/0337945 | A1 | 11/2014 | Jia et al. |
| 2014/0343703 | A1 | 11/2014 | Topchy et al. |
| 2015/0006163 | A1 | 1/2015 | Liu et al. |
| 2015/0033305 | A1 | 1/2015 | Shear et al. |
| 2015/0036462 | A1 | 2/2015 | Calvarese |
| 2015/0088509 | A1 | 3/2015 | Gimenez et al. |
| 2015/0089616 | A1 | 3/2015 | Brezinski et al. |
| 2015/0112682 | A1 | 4/2015 | Rodriguez et al. |
| 2015/0134330 | A1 | 5/2015 | Baldwin et al. |
| 2015/0161370 | A1 | 6/2015 | North et al. |
| 2015/0161459 | A1 | 6/2015 | Boczek |
| 2015/0168996 | A1 | 6/2015 | Sharpe et al. |
| 2015/0245154 | A1 | 8/2015 | Dadu et al. |
| 2015/0261944 | A1 | 9/2015 | Hosom et al. |
| 2015/0301796 | A1 | 10/2015 | Visser et al. |
| 2015/0332665 | A1 | 11/2015 | Mishra et al. |
| 2015/0347734 | A1 | 12/2015 | Beigi |
| 2015/0356974 | A1 | 12/2015 | Tani et al. |
| 2015/0371639 | A1 | 12/2015 | Foerster et al. |
| 2016/0026781 | A1 | 1/2016 | Boczek |
| 2016/0071275 | A1 | 3/2016 | Hirvonen |
| 2016/0086609 | A1 | 3/2016 | Yue et al. |
| 2016/0111112 | A1 | 4/2016 | Hayakawa |
| 2016/0125877 | A1 | 5/2016 | Foerster et al. |
| 2016/0147987 | A1 | 5/2016 | Jang et al. |
| 2016/0210407 | A1 | 7/2016 | Hwang et al. |
| 2016/0217321 | A1 | 7/2016 | Gottleib |
| 2016/0234204 | A1 | 8/2016 | Rishi et al. |
| 2016/0314790 | A1 | 10/2016 | Tsujikawa et al. |
| 2016/0324478 | A1 | 11/2016 | Goldstein |
| 2016/0330198 | A1 | 11/2016 | Stern et al. |
| 2016/0371555 | A1 | 12/2016 | Derakhshani |
| 2017/0011406 | A1 | 1/2017 | Tunnell et al. |
| 2017/0049335 | A1 | 2/2017 | Duddy |
| 2017/0068805 | A1 | 3/2017 | Chandrasekharan et al. |
| 2017/0078780 | A1 | 3/2017 | Qian et al. |
| 2017/0110121 | A1 | 4/2017 | Warlord et al. |
| 2017/0112671 | A1 | 4/2017 | Goldstein |
| 2017/0116995 | A1 | 4/2017 | Ady et al. |
| 2017/0161482 | A1 | 6/2017 | Elton et al. |
| 2017/0169828 | A1 | 6/2017 | Sachdev |
| 2017/0200451 | A1 | 7/2017 | Booklet et al. |
| 2017/0213268 | A1 | 7/2017 | Puehse et al. |
| 2017/0214687 | A1 | 7/2017 | Klein et al. |
| 2017/0231534 | A1 | 8/2017 | Agassy et al. |
| 2017/0279815 | A1 | 9/2017 | Chung et al. |
| 2017/0287490 | A1 | 10/2017 | Biswal et al. |
| 2017/0323644 | A1 | 11/2017 | Kawato |
| 2017/0347180 | A1 | 11/2017 | Petrank |
| 2017/0347348 | A1 | 11/2017 | Masaki et al. |
| 2017/0351487 | A1 | 12/2017 | Aviles-Casco Vaquero et al. |
| 2018/0018974 | A1 | 1/2018 | Zass |
| 2018/0032712 | A1 | 2/2018 | Oh et al. |
| 2018/0039769 | A1 | 2/2018 | Saunders et al. |
| 2018/0047393 | A1 | 2/2018 | Tian et al. |
| 2018/0060557 | A1 | 3/2018 | Valenti et al. |
| 2018/0096120 | A1 | 4/2018 | Boesen |
| 2018/0107866 | A1 | 4/2018 | Li et al. |

(56) References Cited

U.S. PATENT DOCUMENTS

| | | | |
|---|---|---|---|
| 2018/0108225 | A1 | 4/2018 | Mappus et al. |
| 2018/0113673 | A1 | 4/2018 | Sheynblat |
| 2018/0121161 | A1 | 5/2018 | Ueno et al. |
| 2018/0146370 | A1 | 5/2018 | Krishnaswamy et al. |
| 2018/0174600 | A1 | 6/2018 | Chaudhuri et al. |
| 2018/0176215 | A1 | 6/2018 | Perotti et al. |
| 2018/0187969 | A1 | 7/2018 | Kim et al. |
| 2018/0191501 | A1 | 7/2018 | Lindemann |
| 2018/0232201 | A1 | 8/2018 | Holtmann |
| 2018/0232511 | A1 | 8/2018 | Bakish |
| 2018/0239955 | A1 | 8/2018 | Rodriguez et al. |
| 2018/0240463 | A1 | 8/2018 | Perotti |
| 2018/0254046 | A1 | 9/2018 | Khoury et al. |
| 2018/0289354 | A1 | 10/2018 | Cvijanovic et al. |
| 2018/0292523 | A1 | 10/2018 | Orenstein et al. |
| 2018/0308487 | A1 | 10/2018 | Goel et al. |
| 2018/0336716 | A1 | 11/2018 | Ramprashad et al. |
| 2018/0336901 | A1 | 11/2018 | Masaki et al. |
| 2018/0366124 | A1 | 12/2018 | Cilingir et al. |
| 2018/0374487 | A1 | 12/2018 | Lesso |
| 2019/0005963 | A1 | 1/2019 | Alonso et al. |
| 2019/0005964 | A1 | 1/2019 | Alonso et al. |
| 2019/0013033 | A1 | 1/2019 | Bhimanaik et al. |
| 2019/0030452 | A1 | 1/2019 | Fassbender et al. |
| 2019/0042871 | A1 | 2/2019 | Pogorelik |
| 2019/0098003 | A1 | 3/2019 | Ota |
| 2019/0114496 | A1 | 4/2019 | Lesso |
| 2019/0114497 | A1 | 4/2019 | Lesso |
| 2019/0115030 | A1 | 4/2019 | Lesso |
| 2019/0115032 | A1 | 4/2019 | Lesso |
| 2019/0115033 | A1 | 4/2019 | Lesso |
| 2019/0115046 | A1 | 4/2019 | Lesso |
| 2019/0147888 | A1 | 5/2019 | Lesso |
| 2019/0149932 | A1 | 5/2019 | Lesso |
| 2019/0197755 | A1 | 6/2019 | Vats |
| 2019/0199935 | A1 | 6/2019 | Danielsen et al. |
| 2019/0228778 | A1 | 7/2019 | Lesso |
| 2019/0228779 | A1 | 7/2019 | Lesso |
| 2019/0246075 | A1 | 8/2019 | Khadloya et al. |
| 2019/0260731 | A1 | 8/2019 | Chandrasekharan et al. |
| 2019/0294629 | A1 | 9/2019 | Wexler et al. |
| 2019/0295554 | A1 | 9/2019 | Lesso |
| 2019/0306594 | A1 | 10/2019 | Aumer et al. |
| 2019/0311722 | A1 | 10/2019 | Caldwell |
| 2019/0313014 | A1 | 10/2019 | Welbourne et al. |
| 2019/0318035 | A1 | 10/2019 | Blanco et al. |
| 2019/0356588 | A1 | 11/2019 | Shahraray et al. |
| 2019/0371330 | A1 | 12/2019 | Lin et al. |
| 2019/0373438 | A1 | 12/2019 | Amir et al. |
| 2019/0392145 | A1 | 12/2019 | Komogortsev |
| 2019/0394195 | A1 | 12/2019 | Chari et al. |
| 2020/0035247 | A1 | 1/2020 | Boyadjiev et al. |
| 2020/0204937 | A1 | 6/2020 | Lesso |

FOREIGN PATENT DOCUMENTS

| | | | |
|---|---|---|---|
| CN | 104956715 | A | 9/2015 |
| CN | 105185380 | A | 12/2015 |
| CN | 106297772 | A | 1/2017 |
| CN | 106531172 | A | 3/2017 |
| EP | 1205884 | A2 | 5/2002 |
| EP | 1600791 | A1 | 11/2005 |
| EP | 1701587 | A2 | 9/2006 |
| EP | 1928213 | A1 | 6/2008 |
| EP | 1965331 | A2 | 9/2008 |
| EP | 2660813 | A1 | 11/2013 |
| EP | 2704052 | A2 | 3/2014 |
| EP | 2860706 | A2 | 4/2015 |
| EP | 3016314 | A1 | 5/2016 |
| EP | 3156978 | A1 | 4/2017 |
| GB | 2375205 | A | 11/2002 |
| GB | 2493849 | A | 2/2013 |
| GB | 2499781 | A | 9/2013 |
| GB | 2515527 | A | 12/2014 |
| GB | 2541466 | A | 2/2017 |
| GB | 2551209 | A | 12/2017 |
| JP | 2003058190 | A | 2/2003 |
| JP | 2006010809 | A | 1/2006 |
| JP | 2010086328 | A | 4/2010 |
| WO | 9834216 | A2 | 8/1998 |
| WO | 02/103680 | A2 | 12/2002 |
| WO | 2006054205 | A1 | 5/2006 |
| WO | 2007034371 | A2 | 3/2007 |
| WO | 2008113024 | A1 | 9/2008 |
| WO | 2010066269 | A1 | 6/2010 |
| WO | 2013022930 | A1 | 2/2013 |
| WO | 2013154790 | A1 | 10/2013 |
| WO | 2014040124 | A1 | 3/2014 |
| WO | 2015117674 | A1 | 8/2015 |
| WO | 2015163774 | A1 | 10/2015 |
| WO | 2016003299 | A1 | 1/2016 |
| WO | 2017055551 | A1 | 4/2017 |
| WO | 2017203484 | A1 | 11/2017 |

OTHER PUBLICATIONS

Song, Liwei, and Prateek Mittal. "Poster: Inaudible voice commands." Proceedings of the 2017 ACM SIGSAC Conference on Computer and Communications Security. Aug. 2017. (Year: 2017).*

Andrea Fortuna, [online], DolphinAttack: inaudible voice commands allows attackers to control Siri, Alexa and other digital assistants, Sep. 2017. (Year: 2017).*

Combined Search and Examination Report under Sections 17 and 18(3), UKIPO, Application No. GB1801874. dated Jul. 25, 2018.

International Search Report and Written Opinion of the International Searching Authority, International Application No. PCT/GB2019/050185, dated Apr. 2, 2019.

International Search Report and Written Opinion of the International Searching Authority, International Application No. PCT/GB2019/052302, dated Oct. 2, 2019.

Liu, Yuan et al., "Speaker verification with deep features", Jul. 2014, in International Joint Conference on Neural Networks (IJCNN), pp. 747-753, IEEE.

International Search Report and Written Opinion of the International Searching Authority, International Application No. PCT/GB2018/051927, dated Sep. 25, 2018.

Combined Search and Examination Report under Sections 17 and 18(3), UKIPO, Application No. 1801530.5, dated Jul. 25, 2018.

International Search Report and Written Opinion of the International Searching Authority, International Application No. PCT/GB2018/051924, dated Sep. 26, 2018.

Combined Search and Examination Report under Sections 17 and 18(3), UKIPO, Application No. 1801526.3, dated Jul. 25, 2018.

International Search Report and Written Opinion of the International Searching Authority, International Application No. PCT/GB2018/051931, dated Sep. 27, 2018.

Combined Search and Examination Report under Sections 17 and 18(3), UKIPO, Application No. 1801527.1, dated Jul. 25, 2018.

International Search Report and Written Opinion of the International Searching Authority, International Application No. PCT/GB2018/051925, dated Sep. 26, 2018.

Combined Search and Examination Report under Sections 17 and 18(3), UKIPO, Application No. 1801528.9, dated Jul. 25, 2018.

International Search Report and Written Opinion of the International Searching Authority, International Application No. PCT/GB2018/051928, dated Dec. 3, 2018.

Combined Search and Examination Report under Sections 17 and 18(3), UKIPO, Application No. 1801532.1, dated Jul. 25, 2018.

International Search Report and Written Opinion of the International Searching Authority, International Application No. PCT/GB2018/053274, dated Jan. 24, 2019.

Beigi, Homayoon, "Fundamentals of Speaker Recognition," Chapters 8-10, ISBN: 978-0-378-77592-0; 2011.

Li, Lantian et al., "A Study on Replay Attack and Anti-Spoofing for Automatic Speaker Verification", INTERSPEECH 2017, Jan. 1, 2017, pp. 92-96.

Li, Zhi et al., "Compensation of Hysteresis Nonlinearity in Magnetostrictive Actuators with Inverse Multiplicative Structure for Preisach

(56) References Cited

OTHER PUBLICATIONS

Model", IEE Transactions on Automation Science and Engineering, vol. 11, No. 2, Apr. 1, 2014, pp. 613-619.
Partial International Search Report of the International Searching Authority, International Application No. PCT/GB2018/052905, dated Jan. 25, 2019.
Combined Search and Examination Report, UKIPO, Application No. GB1713699.5, dated Feb. 21, 2018.
Combined Search and Examination Report, UKIPO, Application No. GB1713695.3, dated Feb. 19, 2018.
Zhang et al., An Investigation of Deep-Learing Frameworks for Speaker Verification Antispoofing—IEEE Journal of Selected Topics in Signal Processes, Jun. 1, 2017.
Combined Search and Examination Report under Sections 17 and 18(3), UKIPO, Application No. GB1809474.8, dated Jul. 23, 2018.
Wu et al., Anti-Spoofing for text-Independent Speaker Verification: An Initial Database, Comparison of Countermeasures, and Human Performance, IEEE/ACM Transactions on Audio, Speech, and Language Processing, Issue Date: Apr. 2016.
International Search Report and Written Opinion of the International Searching Authority, International Application No. PCT/GB2018/051760, dated Aug. 3, 2018.
International Search Report and Written Opinion of the International Searching Authority, International Application No. PCT/GB2018/051787, dated Aug. 16, 2018.
International Search Report and Written Opinion of the International Searching Authority, International Application No. PCT/GB2018/052907, dated Jan. 15, 2019.
Ajmera, et al., "Robust Speaker Change Detection," IEEE Signal Processing Letters, vol. 11, No. 8, pp. 649-651, Aug. 2004.
Combined Search and Examination Report under Sections 17 and 18(3), UKIPO, Application No. GB1719731.0, dated May 16, 2018.
Further Search Report under Sections 17 (6), UKIPO, Application No. GB1719731.0, dated Nov. 26, 2018.
Combined Search and Examination Report under Sections 17 and 18(3), UKIPO, Application No. GB1801663.4, dated Jul. 18, 2018.
Combined Search and Examination Report under Sections 17 and 18(3), UKIPO, Application No. GB1801659.2, dated Jul. 26, 2018.
Combined Search and Examination Report under Sections 17 and 18(3), UKIPO, Application No. GB1801661.8, dated Jul. 30, 2018.
Combined Search and Examination Report under Sections 17 and 18(3), UKIPO, Application No. GB1801684.2, dated Aug. 1, 2018.
Combined Search and Examination Report under Sections 17 and 18(3), UKIPO, Application No. GB1803570.9, dated Aug. 21, 2018.
Combined Search and Examination Report under Sections 17 and 18(3), UKIPO, Application No. GB1804841.9, dated Sep. 27, 2018.
International Search Report and Written Opinion of the International Searching Authority, International Application No. PCT/GB2018/052906, dated Jan. 14, 2019.
Villalba, Jesus et al., Preventing Replay Attacks on Speaker Verification Systems, International Carnahan Conference on Security Technology (ICCST), 2011 IEEE, Oct. 18, 2011, pp. 1-8.
Combined Search and Examination Report, UKIPO, Application No. GB1713697.9, dated Feb. 20, 2018.
Chen et al., "You Can Hear But You Cannot Steal: Defending Against Voice Impersonation Attacks on Smartphones", Proceedings of the International Conference on Distributed Computing Systems, PD: 20170605.
International Search Report and Written Opinion of the International Searching Authority, International Application No. PCT/GB2018/051765, dated Aug. 16, 2018.
Ohtsuka, Takahiro and Kasuya, Hideki, Robust ARX Speech Analysis Method Taking Voice Source Pulse Train Into Account, Journal of the Acoustical Society of Japan, 58, 7, pp. 386-397, 2002.
Wikipedia, Voice (phonetics), https://en.wikipedia.org/wiki/Voice_(phonetics), accessed Jun. 1, 2020.
Zhang et al., DolphinAttack: Inaudible Voice Commands, Retrieved from Proceedings of the 2017 ACM SIGSAC Conference on Computer and Communications Security, Aug. 2017.
Song, Liwei, and Prateek Mittal, Poster: Inaudible Voice Commands, Proceedings of the 2017 ACM SIGSAC Conference on Computer and Communications Security, Aug. 2017.
Fortuna, Andrea, [Online], DolphinAttack: inaudiable voice commands allow attackers to control Siri, Alexa and other digital assistants, Sep. 2017.
Lucas, Jim, What is Electromagnetic Radiation?, Mar. 13, 2015, Live Science, https://www.livescience.com/38169-ectromagnetism.html, pp. 1-11 (Year 2015).
Brownlee, Jason, A Gentle Introduction to Autocorrelation and Partial Autocorrelation, Feb. 6, 2017, https://machinelearningmastery.com/gentle-introduction-autocorrelation-partial-autocorrelationi, accessed Apr. 28, 2020.
First Office Action, China National Intellectual Property Administration, Patent Application No. 2018800418983, dated May 29, 2020.
International Search Report and Written Opinion, International Application No. PCT/GB2020/050723, dated Jun. 16, 2020.
Liu, Yuxi et al., "Earprint: Transient Evoked Otoacoustic Emission for Biometrics", IEEE Transactions on Information Forensics and Security, IEEE, Piscataway, NJ, US, vol. 9, No. 12, Dec. 1, 2014, pp. 2291-2301.
Seha, Sherif Nagib Abbas et al., "Human recognition using transient auditory evoked potentials: a preliminary study", IET Biometrics, IEEE, Michael Faraday House, Six Hills Way, Stevenage, Herts., UK, vol. 7, No. 3, May 1, 2018, pp. 242-250.
Liu, Yuxi et al., "Biometric identification based on Transient Evoked Otoacoustic Emission", IEEE International Symposium on Signal Processing and Information Technology, IEEE, Dec. 12, 2013, pp. 267-271.

* cited by examiner

ROBUSTNESS OF SPEECH PROCESSING SYSTEM AGAINST ULTRASOUND AND DOLPHIN ATTACKS

TECHNICAL FIELD

Embodiments described herein relate to methods and devices for improving the robustness of a speech processing system.

BACKGROUND

Many devices include microphones, which can be used to detect ambient sounds. In many situations, the ambient sounds include the speech of one or more nearby speaker. Audio signals generated by the microphones can be used in many ways. For example, audio signals representing speech can be used as the input to a speech recognition system, allowing a user to control a device or system using spoken commands.

It has been suggested that it is possible to interfere with the operation of such a system by transmitting an ultrasound signal, which is by definition inaudible to the user of the device, but which is converted into a signal in the audio frequency band by non-linear components of the electronic circuitry in the device, and which will be recognised as speech by the speech recognition system. Such a malicious ultrasonics-based attack is sometimes referred to as a "dolphin attack", due to the similarity with how dolphins communicate in ultrasonic audio bands.

SUMMARY

According to an aspect of the present invention, there is provided a method for improving the robustness of a speech processing system having at least one speech processing module, the method comprising: receiving an input sound signal comprising audio and non-audio frequencies; separating the input sound signal into an audio band component and a non-audio band component; identifying possible interference within the audio band from the non-audio band component; and adjusting the operation of a downstream speech processing module based on said identification.

According to another aspect of the present invention, there is provided a system for improving the robustness of a speech processing system, configured for operating in accordance with the method.

According to another aspect of the present invention, there is provided a device comprising such a system. The device may comprise a mobile telephone, an audio player, a video player, a mobile computing platform, a games device, a remote controller device, a toy, a machine, or a home automation controller or a domestic appliance.

According to another aspect of the present invention, there is provided a computer program product, comprising a computer-readable tangible medium, and instructions for performing a method according to the first aspect.

According to another aspect of the present invention, there is provided a non-transitory computer readable storage medium having computer-executable instructions stored thereon that, when executed by processor circuitry, cause the processor circuitry to perform a method according to the first aspect. According to further aspects of the invention, there is provided a device comprising the non-transitory computer readable storage medium. The device may comprise a mobile telephone, an audio player, a video player, a mobile computing platform, a games device, a remote controller device, a toy, a machine, or a home automation controller or a domestic appliance.

According to another aspect of the present invention, there is provided a method of detecting an ultrasound interference signal, the method comprising:

- filtering an input signal to obtain an audio band component of the input signal;
- filtering the input signal to obtain an ultrasound component of the input signal;
- detecting an envelope of the ultrasound component of the input signal;
- detecting a degree of correlation between the audio band component of the input signal and the envelope of the ultrasound component of the input signal; and
- detecting a presence of an ultrasound interference signal if the degree of correlation between the audio band component of the input signal and the envelope of the ultrasound component of the input signal exceeds a threshold level.

According to another aspect of the present invention, there is provided a method of detecting an ultrasound interference signal, the method comprising:

- filtering an input signal to obtain an audio band component of the input signal;
- filtering the input signal to obtain an ultrasound component of the input signal;
- modifying the ultrasound component to simulate an effect of a non-linear downconversion of the input signal;
- detecting a degree of correlation between the audio band component of the input signal and the modified ultrasound component of the input signal; and
- detecting a presence of an ultrasound interference signal if the degree of correlation between the audio band component of the input signal and the modified ultrasound component of the input signal exceeds a threshold level.

According to another aspect of the present invention, there is provided a method of processing a signal containing an ultrasound interference signal, the method comprising:

- filtering an input signal to obtain an audio band component of the input signal;
- filtering the input signal to obtain an ultrasound component of the input signal;
- modifying the ultrasound component to simulate an effect of a non-linear downconversion of the input signal; and
- comparing the audio band component of the input signal and the modified ultrasound component.

In that case, comparing the audio band component of the input signal and the modified ultrasound component may comprise:

- detecting a degree of correlation between the audio band component of the input signal and the modified ultrasound component of the input signal; and
- detecting a presence of an ultrasound interference signal if the degree of correlation between the audio band component of the input signal and the modified ultrasound component of the input signal exceeds a threshold level.

The method may further comprise sending the audio band component of the input signal to a speech processing module only if no ultrasound interference signal is detected.

The step of comparing the audio band component of the input signal and the modified ultrasound component may comprise:

- applying the modified ultrasound component of the input signal to a filter; and subtracting the filtered modified ultrasound component of the input signal from the audio band component of the input signal to obtain an output signal.

The filter may be an adaptive filter, and the method may comprise adapting the adaptive filter such that the component of the filtered modified ultrasound component in the output signal is minimised.

BRIEF DESCRIPTION OF DRAWINGS

For a better understanding of the present invention, and to show how it may be put into effect, reference will now be made to the accompanying drawings, in which.

DETAILED DESCRIPTION OF EMBODIMENTS

The description below sets forth example embodiments according to this disclosure. Further example embodiments and implementations will be apparent to those having ordinary skill in the art. Further, those having ordinary skill in the art will recognize that various equivalent techniques may be applied in lieu of, or in conjunction with, the embodiments discussed below, and all such equivalents should be deemed as being encompassed by the present disclosure.

The methods described herein can be implemented in a wide range of devices and systems. However, for ease of explanation of one embodiment, an illustrative example will be described, in which the implementation occurs in a smartphone.

Figure 1:
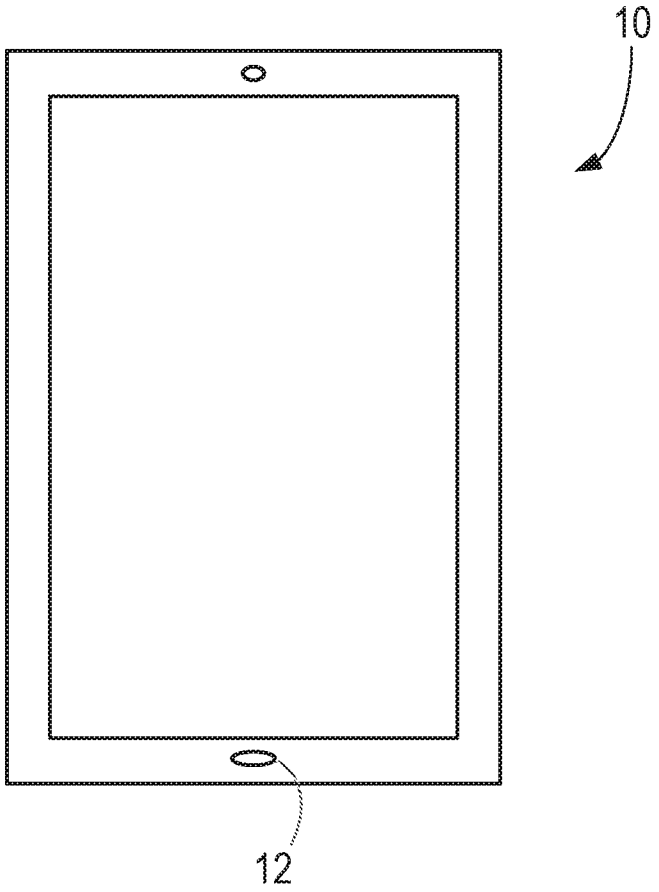
FIG. 1 illustrates a smartphone.

FIG. 1 illustrates a smartphone 10, having a microphone 12 for detecting ambient sounds. In normal use, the microphone is of course used for detecting the speech of a user who is holding the smartphone 10 close to their face.

Figure 2:
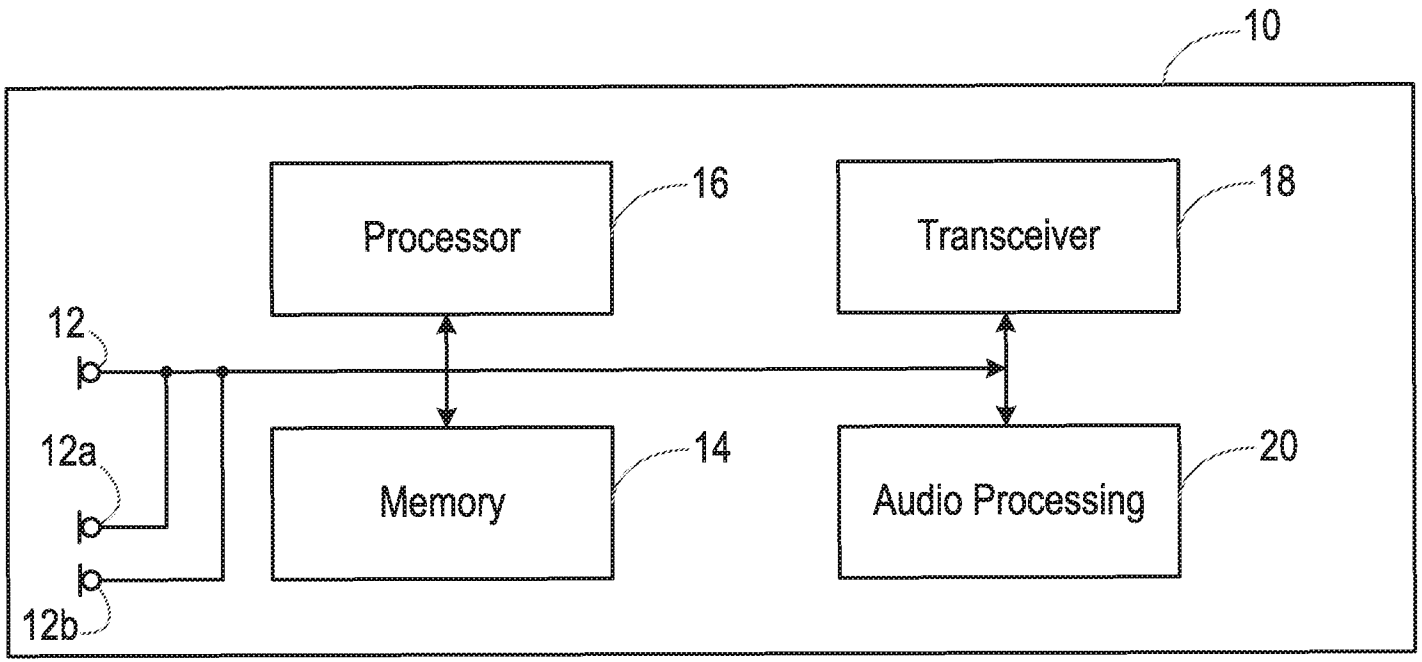
FIG. 2 is a schematic diagram, illustrating the form of the smartphone.

FIG. 2 is a schematic diagram, illustrating the form of the smartphone 10.

Specifically, FIG. 2 shows various interconnected components of the smartphone 10. It will be appreciated that the smartphone 10 will in practice contain many other components, but the following description is sufficient for an understanding of the present invention.

Thus, FIG. 2 shows the microphone 12 mentioned above. In certain embodiments, the smartphone 10 is provided with multiple microphones 12, 12*a*, 12*b*, etc.

FIG. 2 also shows a memory 14, which may in practice be provided as a single component or as multiple components. The memory 14 is provided for storing data and program instructions.

FIG. 2 also shows a processor 16, which again may in practice be provided as a single component or as multiple components. For example, one component of the processor 16 may be an applications processor of the smartphone 10.

FIG. 2 also shows a transceiver 18, which is provided for allowing the smartphone 10 to communicate with external networks. For example, the transceiver 18 may include circuitry for establishing an internet connection either over a WiFi local area network or over a cellular network.

FIG. 2 also shows audio processing circuitry 20, for performing operations on the audio signals detected by the microphone 12 as required. For example, the audio processing circuitry 20 may filter the audio signals or perform other signal processing operations.

In this embodiment, the smartphone 10 is provided with voice biometric functionality, and with control functionality. Thus, the smartphone 10 is able to perform various functions in response to spoken commands from an enrolled user. The biometric functionality is able to distinguish between spoken commands from the enrolled user, and the same commands when spoken by a different person. Thus, certain embodiments of the invention relate to operation of a smartphone or another portable electronic device with some sort of voice operability, for example a tablet or laptop computer, a games console, a home control system, a home entertainment system, an in-vehicle entertainment system, a domestic appliance, or the like, in which the voice biometric functionality is performed in the device that is intended to carry out the spoken command. Certain other embodiments relate to systems in which the voice biometric functionality is performed on a smartphone or other device, which then transmits the commands to a separate device if the voice biometric functionality is able to confirm that the speaker was the enrolled user.

In some embodiments, while voice biometric functionality is performed on the smartphone 10 or other device that is located close to the user, the spoken commands are transmitted using the transceiver 18 to a remote speech recognition system, which determines the meaning of the spoken commands. For example, the speech recognition system may be located on one or more remote server in a cloud computing environment. Signals based on the meaning of the spoken commands are then returned to the smartphone 10 or other local device.

Figure 3:
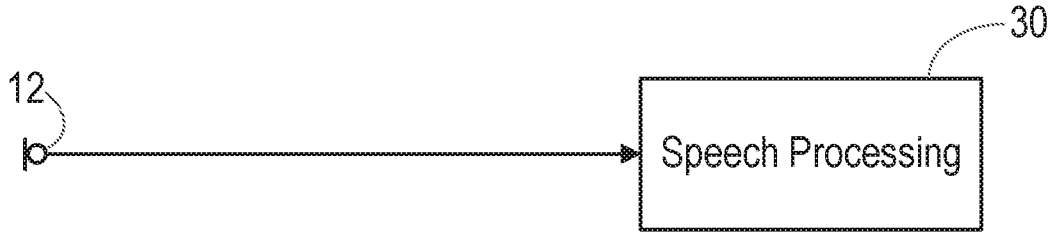
FIG. 3 illustrates a speech processing system.

FIG. 3 is a block diagram illustrating the basic form of a speech processing system in a device 10. Thus, signals received at a microphone 12 are passed to a speech processing block 30. For example, the speech processing block 30 may comprise a voice activity detector, a speaker recognition block for performing a speaker identification or speaker verification process, and/or a speech recognition block for identifying the speech content of the signals. The speech processing block 30 may also comprise signal conditioning circuitry, such as a pre-amplifier, analog-digital conversion circuitry, and the like.

In such a system, there may be a non-linearity in the system. For example, the non-linearity may be in the microphone 12, or may be in signal conditioning circuitry in the speech processing block 30.

The effect of this is non-linearity in the circuitry is that ultrasonic tones may mix down into the audio band.

Figure 4:
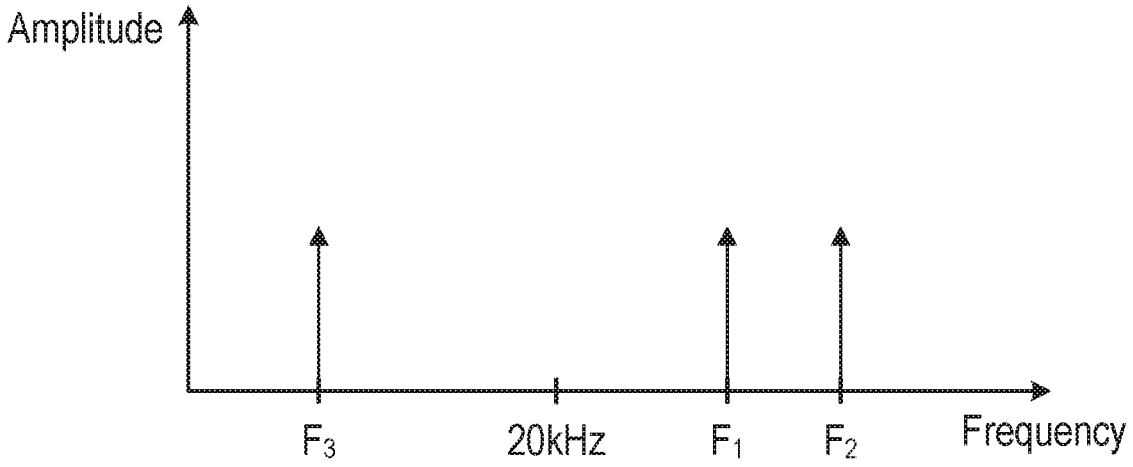
FIG. 4 illustrates an effect of using a speech processing system.

FIG. 4 illustrates this schematically. Specifically, FIG. 4 shows a situation where there are interfering signals at two frequencies $F_1$ and $F_2$ in the ultrasound frequency range (i.e. at frequencies>20 kHz), which mix down as a result of the circuit non-linearity to form a signal at a frequency $F_3$ in the audio frequency range (i.e. at frequencies between about 20 Hz and 20 kHz).

Figure 5:
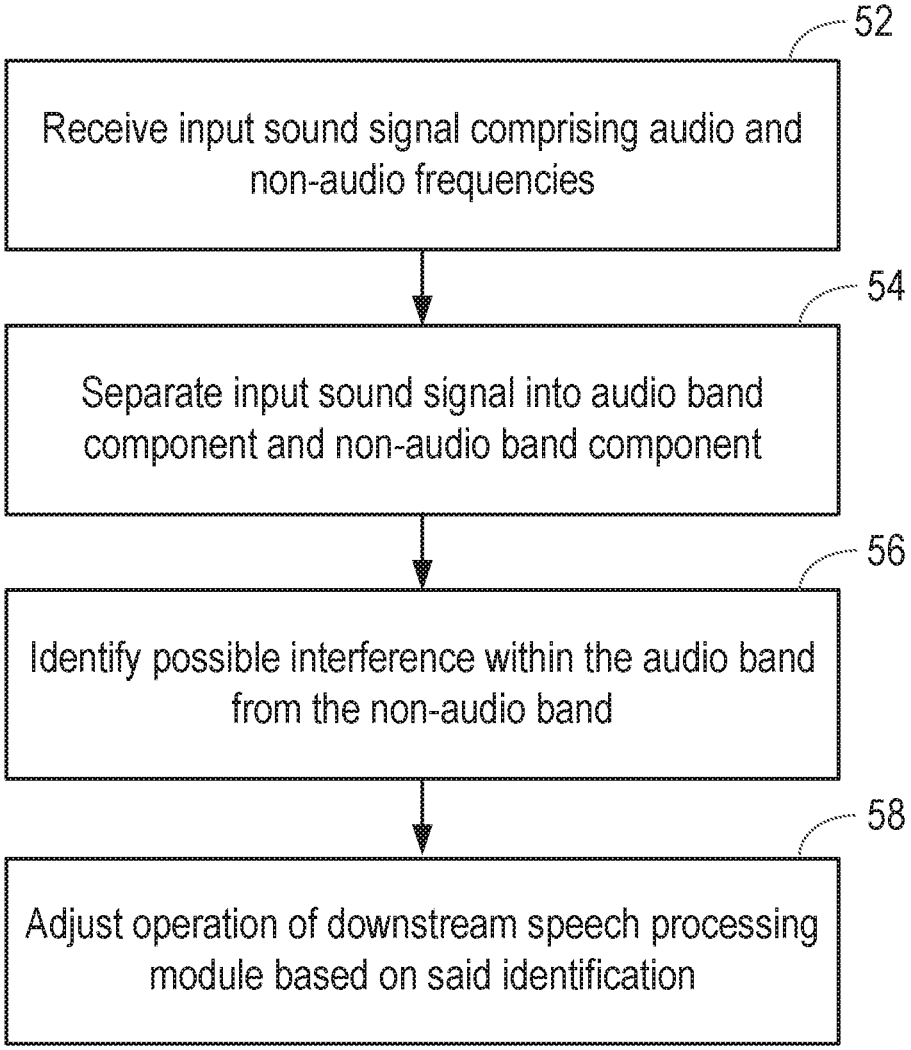
FIG. 5 is a flow chart illustrating a method of handling an audio signal.

FIG. 5 is a flow chart, illustrating a method of analysing an audio signal.

In step 52, the method comprises receiving an input sound signal comprising audio and non-audio frequencies.

In step 54, the method comprises separating the input sound signal into an audio band component and a non-audio band component. The non-audio component may be an ultrasonic component.

In step 56, the method comprises identifying possible interference within the audio band from the non-audio band.

Identifying possible interference within the audio band from the non-audio band component may comprise determining whether a power level of the non-audio band component exceeds a threshold value and, if so, identifying possible interference within the audio band from the non-audio band component.

Alternatively, identifying possible interference within the audio band from the non-audio band component may comprise comparing the audio band and non-audio band components.

Separating the input sound signal into an audio component and a non-audio component, such as an ultrasonic component, makes it possible to identify the presence of potentially problematic non-audio band components which may result in interference in the audio band. Such problematic signals may be present accidentally, as the result of relatively high levels of background sound signals, such as ultrasonic signals from ultrasonic sensor devices or modems. Alternatively, the problematic signals may be generated by a malicious actor in an attempt to interfere with or spoof the operation of a speech processing system, for example by generating ultrasonic signals that mix down as a result of circuit non-linearities to form audio band signals that can be misinterpreted as speech, or by generating ultrasonic signals that interfere with other aspects of the processing.

In step 58, the method comprises adjusting the operation of a downstream speech processing module based on said identification of possible interference.

The adjusting of the operation of the speech processing module may take the form of modifications to the speech processing that is performed by the speech processing module, or may take the form of modifications to the signal that is applied to the speech processing module.

For example, modifications to the speech processing that is performed by the speech processing module may involve placing less (or zero) reliance on the speech signal during time periods when possible interference is identified, or warning a user that there is possible interference.

For example, modifications to the signal that is applied to the speech processing module may take the form of attempting to remove the effect of the interference.

Figure 6:
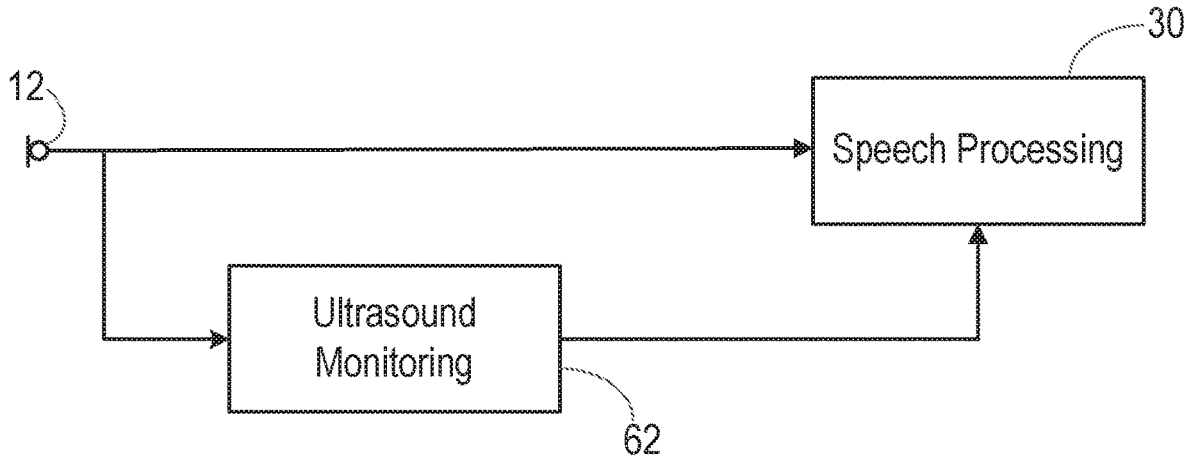
FIG. 6 is a block diagram illustrating a system using the method of FIG. 5.

FIG. 6 is a block diagram illustrating the basic form of a speech processing system in a device 10. As in FIG. 3, signals received at a microphone 12 are passed to a speech processing block 30. Again, as in FIG. 3, the speech processing block 30 may comprise a voice activity detector, a speaker recognition block for performing a speaker identification or speaker verification process, and/or a speech recognition block for identifying the speech content of the signals. The speech processing block 30 may also comprise signal conditioning circuitry, such as a pre-amplifier, analog-digital conversion circuitry, and the like.

As mentioned with respect to FIG. 3, there may be a non-linearity in the system. For example, the non-linearity may be in the microphone 12, or may be in signal conditioning circuitry in the speech processing block 30.

In the system of FIG. 6, the received signals are also passed to an ultrasound monitoring block 62, which separates the input sound signal into an audio band component and a non-audio band component, which may be an ultrasonic component, and identifies possible interference within the audio band from the non-audio band component.

If a source of possible interference is identified, the speech processing that is performed by the speech processing module may be modified appropriately.

Figure 7:
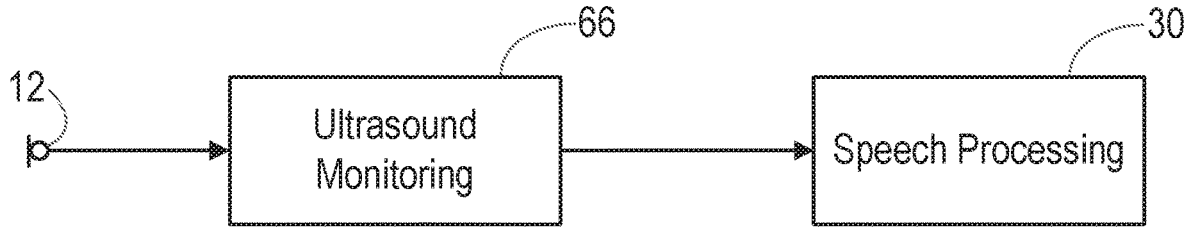
FIG. 7 is a block diagram illustrating a system using the method of FIG. 5.

FIG. 7 is a block diagram illustrating the basic form of a speech processing system in a device 10. In the system of FIG. 7, signals received at a microphone 12 are passed to an ultrasound monitoring block 66, which separates the input sound signal into an audio band component and a non-audio band component, which may be an ultrasonic component, and identifies possible interference within the audio band from the non-audio band component, resulting for example from non-linearity in the microphone 12.

If a source of possible interference is identified, the received signal may be modified appropriately, and the modified signal may then be applied to the speech processing module 30.

As in FIG. 3, the speech processing block 30 may comprise a voice activity detector, a speaker recognition block for performing a speaker identification or speaker verification process, and/or a speech recognition block for identifying the speech content of the signals. The speech processing block 30 may also comprise signal conditioning circuitry, such as a pre-amplifier, analog-digital conversion circuitry, and the like.

Figure 8:
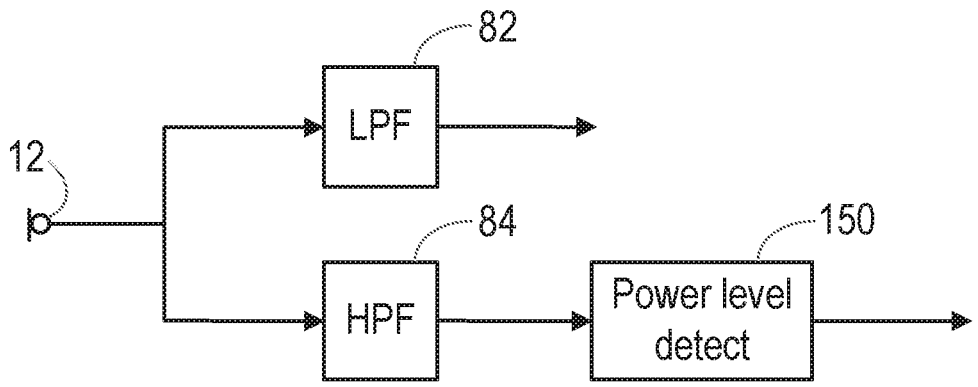
FIG. 8 is a block diagram of a system using the method of FIG. 5.

FIG. 8 is a block diagram, illustrating the form of the ultrasound monitoring block 62 or 66, in some embodiments.

In this embodiment, signals received from the microphone 12 are separated into an audio band component and a non-audio band component. The received signals are passed to a low-pass filter (LPF) 82, for example a low-pass filter with a cut-off frequency at or below ~20 kHz, which filters the input sound signal to obtain an audio band component of the input sound signal. The received signals are also passed to a high-pass filter (HPF) 84, for example a high-pass filter with a cut-off frequency at or above ~20 kHz, to obtain a non-audio band component of the input sound signal, which will be an ultrasound signal when the high-pass filter has a cut-off frequency at or above ~20 kHz. In other embodiments, the HPF 84 may be replaced by a band-pass filter, for example with a pass-band from ~20 kHz to ~90 kHz. Again, the non-audio band component of the input sound signal will be an ultrasound signal when the low frequency end of the pass band of the band-pass filter is at or above ~20 kHz.

The non-audio band component of the input sound signal is passed to a power level detect block 150, which determines whether a power level of the non-audio band component exceeds a threshold value. For example, the power level detect block 150 may determine whether the peak non-audio band (e.g. ultrasound) power level exceeds a threshold. For example, it may determine whether the peak ultrasound power level exceeds −30 dBFS (decibels relative to full scale). Such a level of ultrasound may result from an attack by a malicious party. In any event, if the ultrasound power level exceeds the threshold value, it could be identified that this may result in interference in the audio band due to non-linearities.

The threshold value may be set based on knowledge of the effect of the non-linearity in the circuit. Thus, if the effect of the nonlinearity is known to be a value A(nl), for example a 40 dB mixdown, it is possible to set a threshold A(bb) for a power level in the audio base band which could affect system operation, for example 30 dB SPL.

Then, an ultrasonic signal at or above A(us), where A(us)=A(bb)+A(nl), would cause problems in the audio band, because the non-linearity would cause it to generate a base band signal above the threshold at which system operation could be affected. With the examples given above, where A(nl)=40 dB and A(bb)=30 dB SPL, this gives a threshold value of 70 dB for the ultrasound power level.

If it is determined that the ultrasound power level exceeds the threshold value, the output of the power level detect block 150 may be a flag, to be sent to the downstream speech processing module in step 58 of the method of FIG. 5, in order to control the operation thereof.

Figure 9:
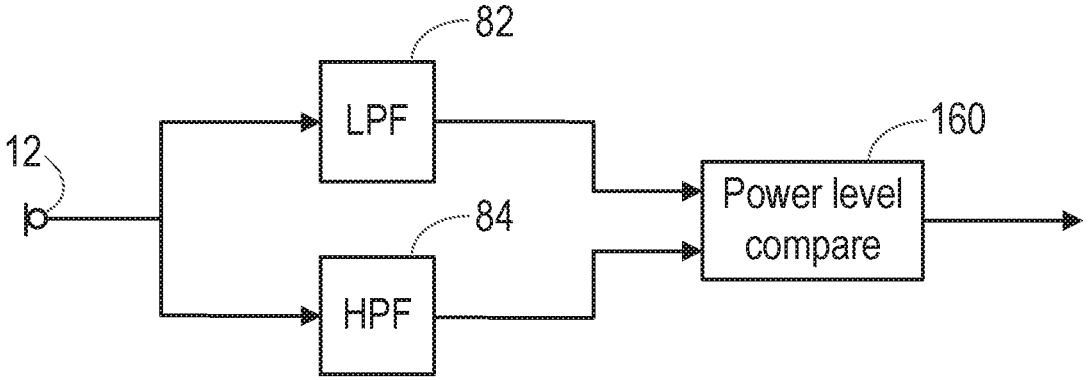
FIG. 9 is a block diagram of a system using the method of FIG. 5.

FIG. 9 is a block diagram, illustrating the form of the ultrasound monitoring block 62 or 66, in some embodiments.

In this embodiment, signals received from the microphone 12 are separated into an audio band component and a non-audio band component. The received signals are passed to a low-pass filter (LPF) 82, for example a low-pass filter with a cut-off frequency at or below ~20 kHz, which filters the input sound signal to obtain an audio band component of the input sound signal. The received signals are also passed to a high-pass filter (HPF) 84, for example a high-pass filter with a cut-off frequency at or above ~20 kHz, to obtain a non-audio band component of the input sound signal, which will be an ultrasound signal when the high-pass filter has a cut-off frequency at or above ~20 kHz. In other embodiments, the HPF 84 may be replaced by a band-pass filter, for example with a pass-band from ~20 kHz to ~90 kHz. Again, the non-audio band component of the input sound signal will be an ultrasound signal when the low frequency end of the pass band of the band-pass filter is at or above ~20 kHz.

The non-audio band component of the input sound signal is passed to a power level compare block 160. This compares the audio band and non-audio band components.

For example, in this case, identifying possible interference within the audio band from the non-audio band component may comprise: measuring a signal power in the audio band component $P_a$; measuring a signal power in the non-audio band component $P_b$. Then, if $(P_a/P_b)$ is less than a threshold limit, it could be identified that this may result in interference in the audio band due to non-linearities.

In that case, the output of the power level compare block 160 may be a flag, to be sent to the downstream speech processing module in step 58 of the method of FIG. 5, in order to control the operation thereof. More specifically, this flag may indicate to the speech processing module that the quality of the input sound signal is unreliable for speech processing. The operation of the downstream speech processing module may then be controlled based on the flagged unreliable quality.

Figure 10:
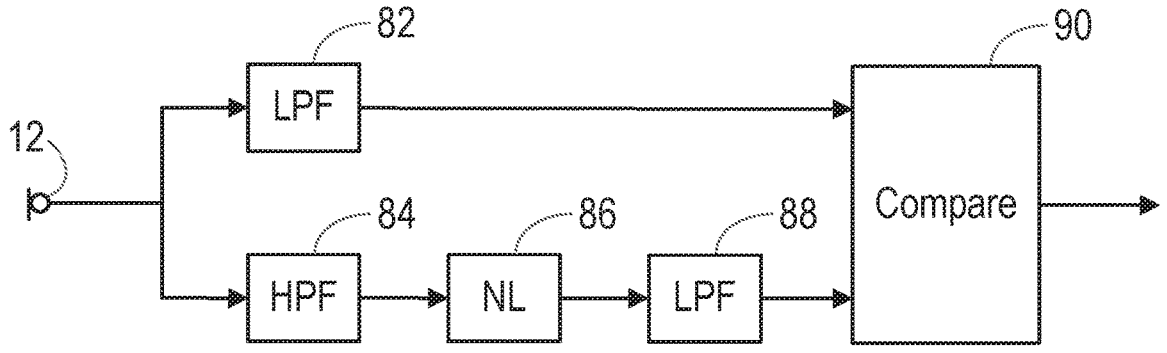
FIG. 10 is a block diagram of a system using the method of FIG. 5.

FIG. 10 is a block diagram, illustrating the form of the ultrasound monitoring block 62 or 66, in some embodiments.

Signals received from the microphone 12 are separated into an audio band component and a non-audio band component. The received signals are passed to a low-pass filter (LPF) 82, for example a low-pass filter with a cut-off frequency at or below ~20 kHz, which filters the input sound signal to obtain an audio band component of the input sound signal. The received signals are also passed to a high-pass filter (HPF) 84, for example a high-pass filter with a cut-off frequency at or above ~20 kHz, to obtain a non-audio band component of the input sound signal, which will be an ultrasound signal when the high-pass filter has a cut-off frequency at or above ~20 kHz. In other embodiments, the HPF 84 may be replaced by a band-pass filter, for example with a pass-band from ~20 kHz to ~90 kHz. Again, the non-audio band component of the input sound signal will be an ultrasound signal when the low frequency end of the pass band of the band-pass filter is at or above ~20 kHz.

The non-audio band component of the input sound signal may be passed to a block 86 that simulates the effect of a non-linearity on the signal, and then to a low-pass filter 88.

The audio band component generated by the low-pass filter 82 and the simulated non-linear signal generated by the block 86 and the low-pass filter 88 are then passed to a comparison block 90.

In one embodiment, the comparison block 90 measures a signal power in the audio band component, measures a signal power in the non-audio band component, and calculates a ratio of the signal power in the audio band component to the signal power in the non-audio band component. If this ratio is below a threshold limit, this is taken to indicate that the input sound signal may contain too high a level of ultrasound to be reliably used for speech processing. In that case, the output of the comparison block 90 may be a flag, to be sent to the downstream speech processing module in step 58 of the method of FIG. 5, in order to control the operation thereof.

In another embodiment, the comparison block 90 detects the envelope of the signal of the non-audio band component, and detects a level of correlation between the envelope of the signal and the audio band component. Detecting the level of correlation may comprise measuring a time-domain correlation between identified signal envelopes of the non-audio band component, and speech components of the audio band component. In this situation, some or all of the audio band component may result from ultrasound signals in the ambient sound, that have been downconverted into the audio band by non-linearities in the microphone 12. This will lead to a correlation with the non-audio band component that is selected by the filter 84. Therefore, the presence of such a correlation exceeding a threshold value is taken as an indication that there may be non-audio band interference within the audio band.

In that case, the output of the comparison block 90 may be a flag, to be sent to the downstream speech processing module in step 58 of the method of FIG. 5, in order to control the operation thereof.

In another embodiment, the block 86 simulates the effect of a non-linearity on the signal, to provide a simulated non-linear signal. For example, the block 86 may attempt to model the non-linearity in the system that may be causing the interference by non-linear downconversion of the input sound signal. The non-linearities simulated by the block 86 may be second-order and/or third-order non-linearities.

In that embodiment, the comparison block 90 then detects a level of correlation between the simulated non-linear signal and the audio band component. If the level of correlation exceeds a threshold value, then it is determined that there may be interference within the audio band caused by signals from the non-audio band.

Again, in that case, the output of the comparison block 90 may be a flag, to be sent to the downstream speech processing module in step 58 of the method of FIG. 5, in order to control the operation thereof.

Figure 11:
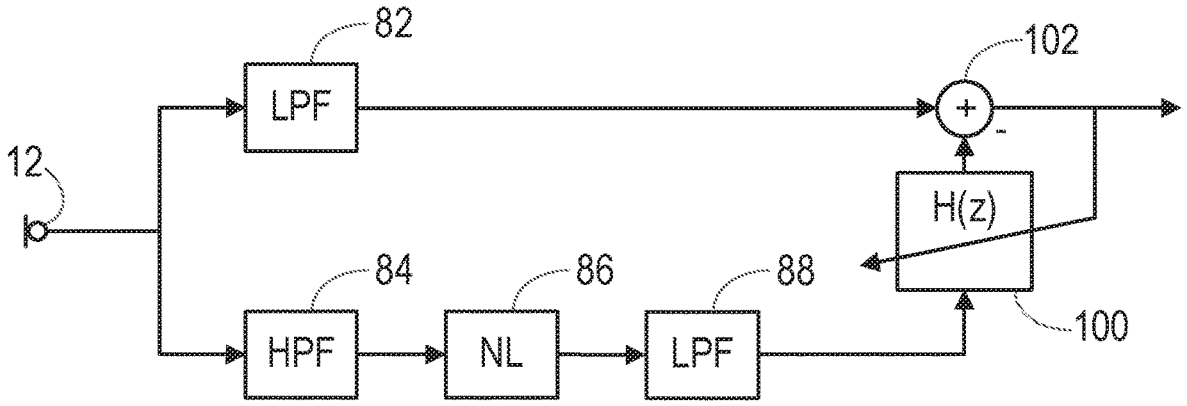
FIG. 11 is a block diagram of a system using the method of FIG. 5.

FIG. 11 is a block diagram, illustrating the form of the ultrasound monitoring block 66, in some other embodiments.

Signals received from the microphone 12 are separated into an audio band component and a non-audio band component. The received signals are passed to a low-pass filter (LPF) 82, for example a low-pass filter with a cut-off frequency at or below ~20 kHz, which filters the input sound signal to obtain an audio band component of the input sound signal. The received signals are also passed to a high-pass filter (HPF) 84, for example a high-pass filter with a cut-off frequency at or above ~20 kHz, to obtain a non-audio band component of the input sound signal, which will be an ultrasound signal when the high-pass filter has a cut-off frequency at or above ~20 kHz. In other embodiments, the HPF 84 may be replaced by a band-pass filter, for example with a pass-band from ~20 kHz to ~90 kHz. Again, the non-audio band component of the input sound signal will be an ultrasound signal when the low frequency end of the pass band of the band-pass filter is at or above ~20 kHz.

The non-audio band component of the input sound signal may be passed to a block 86 that simulates the effect of a non-linearity on the signal, and then to a low-pass filter 88.

In the case of the embodiments shown in FIG. 11, the adjustment of the operation of the downstream speech processing module, in step 58 of the method of FIG. 5, comprises providing a compensated sound signal to the downstream speech processing module.

The step of providing the compensated sound signal may comprise subtracting the simulated non-linear signal from the audio band component to provide the compensated output signal, which is then provided to the downstream speech processing module.

In the embodiment of FIG. 11, the simulated non-linear signal generated by the block 86 and the low-pass filter 88 are passed to a further filter 100.

The audio band component generated by the low-pass filter 82 is passed to a subtractor 102, and the output of the further filter 100 is subtracted from the audio band component, in order to remove from the audio band signal any component caused by downconversion of ultrasound signals. The further filter 100 may be an adaptive filter, and in its simplest form it may be an adaptive gain. The further filter 100 is adapted such that the component of the filtered simulated non-linearity signal in the compensated output signal is minimised.

The resulting compensated audio band signal is passed to the downstream speech processing module.

Figure 12:
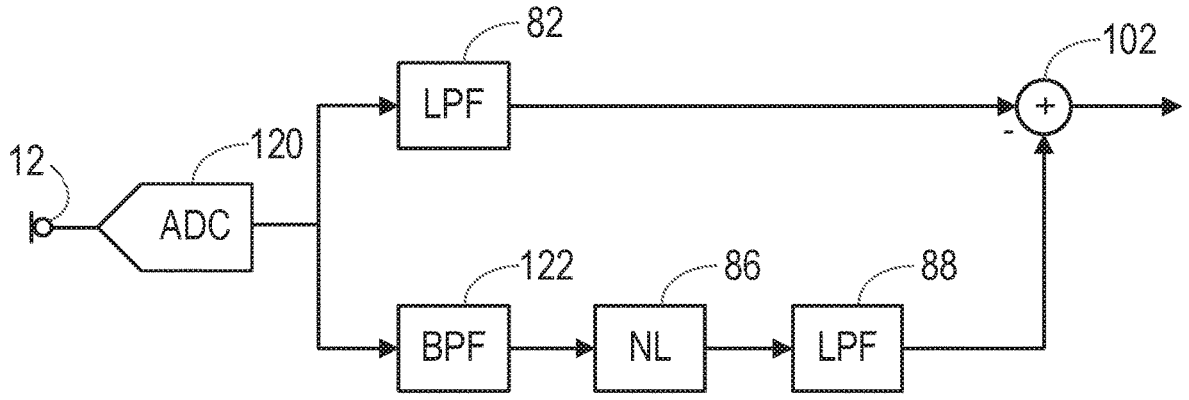
FIG. 12 is a block diagram of a system using the method of FIG. 5.

FIG. 12 is a block diagram, illustrating the form of the ultrasound monitoring block 66, in some other embodiments.

In the embodiments illustrated above, the signals from the microphone 12 may be analog signals, and they may be passed to an analog-digital converter for conversion to digital form before being passed to the respective filters. However, for ease of illustration, in cases where it is assumed that the analog-digital conversion is not the source of non-linearity that causes ultrasound signals to be mixed down into the audio band, the analog-digital converters have not been shown in the figures.

However, FIG. 12 shows a case in which the analog-digital conversion is not ideal, and so FIG. 12 shows signals received from the microphone 12 being passed to an analog-digital converter (ADC) 120.

Again, the resulting signal is separated into an audio band component and a non-audio band component. The received signals are passed to a low-pass filter (LPF) 82, for example a low-pass filter with a cut-off frequency at or below ~20 kHz, which filters the input sound signal to obtain an audio band component of the input sound signal.

In general the bandwidth of the ADC must be large enough to be able to handle the ultrasonic components of the received signal. However, in any real ADC, there will be a frequency at which the quantization noise of the ADC will start to rise. This places an upper limit on the frequencies that can be allowed into the non-linearity. Therefore, FIG. 12 shows the output of the ADC 120 being passed not to a high-pass filter, but to a band-pass filter (BPF) 122. The lower end of the pass-band may for example be at ~20 kHz, with the upper end of the pass-band being at a frequency that excludes the frequencies that are corrupted by quantization noise, for example at ~90 kHz.

As in other embodiments, the non-audio band component of the input sound signal may be passed to a block 86 that simulates the effect of a non-linearity on the signal, and then to a low-pass filter 88.

In the case of the embodiments shown in FIG. 12, the adjustment of the operation of the downstream speech processing module, in step 58 of the method of FIG. 5, comprises providing a compensated sound signal to the downstream speech processing module.

In this illustrated example, the step of providing the compensated sound signal may comprise subtracting the simulated non-linear signal from the audio band component to provide the compensated output signal, which is then provided to the downstream speech processing module.

Thus, in FIG. 12, the audio band component generated by the low-pass filter 82 is passed to a subtractor 102, and the simulated non-linear signal generated by the block 86 and the low-pass filter 88 is subtracted from the audio band component. This attempts to remove from the audio band signal any component caused by downconversion of ultrasound signals.

The resulting compensated audio band signal is passed to the downstream speech processing module.

Figure 13:
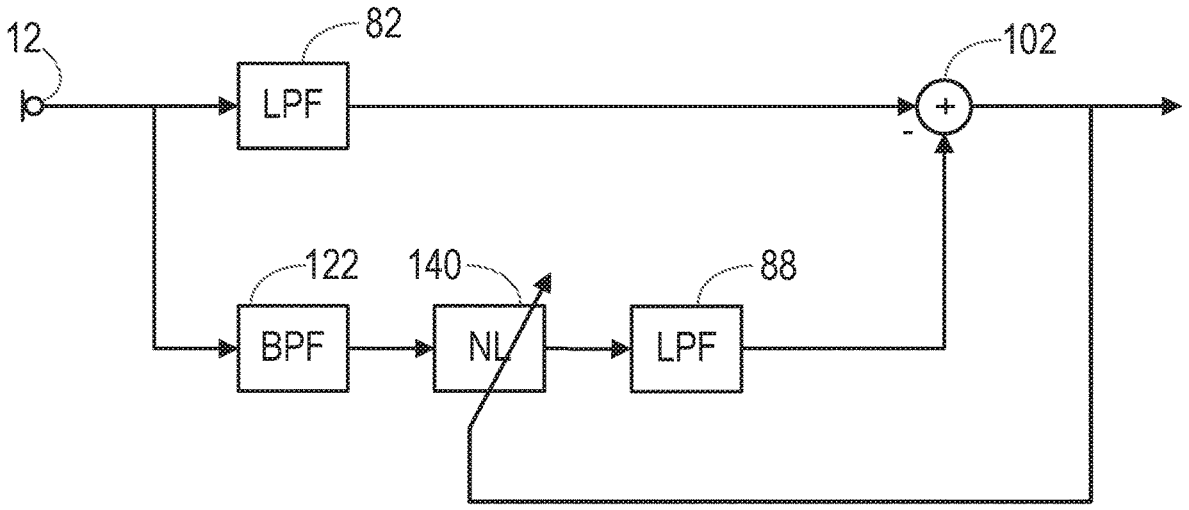
FIG. 13 is a block diagram of a system using the method of FIG. 5.

FIG. 13 is a block diagram, illustrating the form of the ultrasound monitoring block 66, in some other embodiments, where the non-linearity in the microphone 12 or elsewhere is unknown (for example the magnitude of the non-linearity and/or the relative strengths of $2^{nd}$ order non-linearity and $3^{rd}$ order non-linearity). In this case, the step of simulating a non-linearity comprises providing the non-audio band component to an adaptive non-linearity module, and the method comprises controlling the adaptive non-linearity module such that the component of the simulated non-linearity signal in the compensated output signal is minimised.

Thus, FIG. 13 shows the received signal being passed to a low-pass filter (LPF) 82, for example a low-pass filter with a cut-off frequency at or below ~20 kHz, which filters the input sound signal to obtain an audio band component of the input sound signal.

FIG. 13 shows the received signal being passed to a band-pass filter (BPF) 122. The lower end of the pass-band may for example be at ~20 kHz, with the upper end of the pass-band being at a frequency that excludes the frequencies that are corrupted by quantization noise, for example at ~90 kHz.

In these embodiments, the non-audio band component of the input sound signal may be passed to an adaptive block 140 that simulates the effect of a non-linearity on the signal. The output of the block 140 is passed to a low-pass filter 88.

As before, the adjustment of the operation of the downstream speech processing module, in step 58 of the method of FIG. 5, comprises providing a compensated sound signal to the downstream speech processing module.

More specifically, in this illustrated example, the step of providing the compensated sound signal may comprise subtracting the simulated non-linear signal from the audio band component to provide the compensated output signal, which is then provided to the downstream speech processing module.

Thus, in FIG. 13, the audio band component generated by the low-pass filter 82 is passed to a subtractor 102, and the simulated non-linear signal generated by the block 140 and the low-pass filter 88 is subtracted from the audio band component. This attempts to remove from the audio band signal any component caused by downconversion of ultrasound signals.

The resulting compensated audio band signal is passed to the downstream speech processing module.

In one example, the non-linearity may be modelled in the block 140 with a polynomial p(x), with the error being fed back from the output of the subtractor 102.

The Least Mean Squares algorithm may update the m-th polynomial term $p_m$ as per:

$$p_m \rightarrow p_m + \mu \cdot \varepsilon \cdot x^m$$

$$p_m \rightarrow p_m + \mu \cdot (x - \alpha) \cdot x^m.$$

An alternative version applies a filtering to the error signal:

$$p_m \rightarrow p_m + \mu \cdot \lambda\{(x - \alpha) \cdot x^m\},$$

where $\lambda$ is a filter function.

For example a simple Boxcar filter could be used.

Any of the embodiments described above can be used in a two-stage system, in which the first stage corresponds to that shown in FIG. 8. That is, the received signal is filtered to obtain an audio band component and a non-audio band (for example, ultrasound) component of the input signal. It is then determined whether the signal power in the non-audio band component is below or above a threshold value. If there is a low power level in the ultrasound band, this indicates that there is unlikely to be a problem caused by downconversion of audio signals to the audio band. If there is a higher power level in the ultrasound band, there is a possibility of a problem, and so the further processing described above with reference to FIG. 10, 11, 12 or 13 is performed to determine if interference is likely, and to take mitigating action if required. For example, if the measured signal power level in the non-audio band component is below a threshold level X, the input sound signal may be flagged as free of non-audio band interference, and, if the measured signal power level in the non-audio band component is above a threshold level X, the audio band and non-audio band components may be compared to identify possible interference within the audio band from the non-audio band.

This allows for low-power operation, as the comparison step will only be performed in situations where the non-audio band component has a signal power above the threshold level. For a non-audio band component having signal power below such a threshold, it can be assumed that no interference will be present in the input sound signal used for downstream speech processing.

The skilled person will recognise that some aspects of the above-described apparatus and methods may be embodied as processor control code, for example on a non-volatile carrier medium such as a disk, CD- or DVD-ROM, programmed memory such as read only memory (Firmware), or on a data carrier such as an optical or electrical signal carrier. For many applications embodiments of the invention will be implemented on a DSP (Digital Signal Processor), ASIC (Application Specific Integrated Circuit) or FPGA (Field Programmable Gate Array). Thus the code may comprise conventional program code or microcode or, for example code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (Very high speed integrated circuit Hardware Description Language). As the skilled person will appreciate, the code may be distributed between a plurality of coupled components in communication with one another. Where appropriate, the embodiments may also be implemented using code running on a field-(re)programmable analogue array or similar device in order to configure analogue hardware.

Note that as used herein the term module shall be used to refer to a functional unit or block which may be implemented at least partly by dedicated hardware components such as custom defined circuitry and/or at least partly be implemented by one or more software processors or appropriate code running on a suitable general purpose processor or the like. A module may itself comprise other modules or functional units. A module may be provided by multiple components or sub-modules which need not be co-located and could be provided on different integrated circuits and/or running on different processors.

Embodiments may be implemented in a host device, especially a portable and/or battery powered host device such as a mobile computing device for example a laptop or tablet computer, a games console, a remote control device, a home automation controller or a domestic appliance including a domestic temperature or lighting control system, a toy, a machine such as a robot, an audio player, a video player, or a mobile telephone for example a smartphone.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference numerals or labels in the claims shall not be construed so as to limit their scope.

The invention claimed is:

1. A method for improving the robustness of a speech processing system having at least one speech processing module, the method comprising:

receiving an input sound signal comprising audio and non-audio frequencies;

separating the input sound signal into an audio band component and a non-audio band component;

identifying possible interference within the audio band from the non-audio band component, wherein the step of identifying possible interference within the audio band from the non-audio band component comprises:

comparing the audio band and non-audio band components;

measuring a signal power in the audio band component $P_a$;

measuring a signal power in the non-audio band component $P_b$; and if $(P_a/P_b)$<threshold limit, flagging the quality of the input sound signal as unreliable for speech processing; and adjusting operation of a downstream speech processing module based on said identification, wherein the step of adjusting comprises controlling the operation of a downstream speech processing module based on the flagged unreliable quality.

2. The method of claim 1, wherein identifying possible interference within the audio band from the non-audio band component comprises determining whether a power level of the non-audio band component exceeds a threshold value and, if so, identifying possible interference within the audio band from the non-audio band component.

3. The method of claim 1, wherein the step of separating comprises:

filtering the input sound signal to obtain an audio band component of the input sound signal; and filtering the input sound signal to obtain a non-audio band component of the input sound signal.

4. The method of claim 1, wherein the speech processing system is a voice biometrics system.

5. A method for improving the robustness of a speech processing system having at least one speech processing module, the method comprising:

receiving an input sound signal comprising audio and non-audio frequencies;

separating the input sound signal into an audio band component and a non-audio band component;

identifying possible interference within the audio band from the non-audio band component, wherein the step of identifying possible interference within the audio band from the non-audio band component comprises comparing the audio band and non-audio band components, and wherein the step of comparing comprises:

detecting an envelope of the non-audio band component;

detecting a level of correlation between the envelope of the non-audio band component and the audio band component; and determining possible non-audio band interference within the audio band if the level of correlation exceeds a threshold value; and adjusting operation of a downstream speech processing module based on said identification.

6. The method of claim 5, wherein the step of adjusting comprises flagging a detection of possible non-audio band interference within the audio band to a downstream speech processing module.

7. The method of claim 5, wherein the step of separating comprises:

filtering the input sound signal to obtain an audio band component of the input sound signal; and filtering the input sound signal to obtain a non-audio band component of the input sound signal.

8. The method of claim 5, wherein the speech processing system is a voice biometrics system.

9. A method for improving the robustness of a speech processing system having at least one speech processing module, the method comprising:

receiving an input sound signal comprising audio and non-audio frequencies;

separating the input sound signal into an audio band component and a non-audio band component;

identifying possible interference within the audio band from the non-audio band component, wherein the step of identifying possible interference within the audio band from the non-audio band component comprises comparing the audio band and non-audio band components, and wherein the step of comparing comprises:

simulating an effect of a non-linearity on the non-audio band component to provide a simulated non-linear signal;

detecting a level of correlation between the simulated non-linear signal and the audio band component; and determining possible non-audio band interference within the audio band if the level of correlation exceeds a threshold value; and adjusting operation of a downstream speech processing module based on said identification.

10. The method of claim 9, wherein the step of separating comprises:

filtering the input sound signal to obtain an audio band component of the input sound signal; and filtering the input sound signal to obtain a non-audio band component of the input sound signal.

11. The method of claim 9, wherein the speech processing system is a voice biometrics system.

12. A method for improving the robustness of a speech processing system having at least one speech processing module, the method comprising:

receiving an input sound signal comprising audio and non-audio frequencies;

separating the input sound signal into an audio band component and a non-audio band component;

identifying possible interference within the audio band from the non-audio band component; and adjusting operation of a downstream speech processing module based on said identification, wherein the step of adjusting comprises providing a compensated sound signal to a downstream speech processing module; and wherein the step of providing a compensated sound signal comprises:

subtracting a simulated non-linear signal from the audio band component to provide a compensated output signal; and providing the compensated output signal to a downstream speech processing module.

13. The method of claim 12, wherein the step of subtracting comprises:

applying the simulated non-linearity signal to a filter; and subtracting the filtered simulated non-linearity signal from the audio band component of the input sound signal to provide a compensated output signal.

14. A method according to claim 13, wherein the filter is an adaptive filter, and the method comprises adapting the adaptive filter such that the component of the filtered simulated non-linearity signal in the compensated output signal is minimised.

15. The method of claim 14, wherein adapting the adaptive filter comprises adapting a gain of the filter.

16. The method of claim 14, wherein adapting the adaptive filter comprises adapting filter coefficients of the filter.

17. The method of claim 12, wherein the step of separating comprises:

filtering the input sound signal to obtain an audio band component of the input sound signal; and filtering the input sound signal to obtain a non-audio band component of the input sound signal.

18. The method of claim 12, wherein the speech processing system is a voice biometrics system.

19. A method for improving the robustness of a speech processing system having at least one speech processing module, the method comprising:

receiving an input sound signal comprising audio and non-audio frequencies;

separating the input sound signal into an audio band component and a non-audio band component;

identifying possible interference within the audio band from the non-audio band component, wherein the step of identifying possible interference within the audio band from the non-audio band component comprises comparing the audio band and non-audio band components; and adjusting operation of a downstream speech processing module based on said identification;

wherein the steps of comparing and adjusting comprise:

simulating an effect of a non-linearity on the non-audio band component to provide a simulated non-linear signal;

subtracting the simulated non-linear signal from the audio band component to provide a compensated output signal; and providing the compensated output signal to a downstream speech processing module.

20. The method of claim 19, wherein the step of simulating the effect of the non-linearity comprises providing the non-audio band component to an adaptive non-linearity module, and wherein the method comprises controlling the adaptive non-linearity module such that the component of the simulated non-linearity signal in the compensated output signal is minimised.

21. The method of claim 19, wherein the step of separating comprises:

filtering the input sound signal to obtain an audio band component of the input sound signal; and filtering the input sound signal to obtain a non-audio band component of the input sound signal.

22. The method of claim 19, wherein the speech processing system is a voice biometrics system.

23. A method for improving the robustness of a speech processing system having at least one speech processing module, the method comprising:

receiving an input sound signal comprising audio and non-audio frequencies;

separating the input sound signal into an audio band component and a non-audio band component;

identifying possible interference within the audio band from the non-audio band component;

adjusting operation of a downstream speech processing module based on said identification; and measuring a signal power in the non-audio band component $P_b$, wherein the method is responsive to the step of measuring the signal power, such that:

if the measured signal power level $P_b$ is below a threshold level X, the method comprises flagging the input sound signal as free of non-audio band interference, and if the measured signal power level $P_b$ is above a threshold level X, the method performs the step of identifying possible interference within the audio band from the non-audio band component.

24. The method of claim 23, wherein the step of separating comprises:

filtering the input sound signal to obtain an audio band component of the input sound signal; and filtering the input sound signal to obtain a non-audio band component of the input sound signal.

25. The method of claim 23, wherein the speech processing system is a voice biometrics system.

26. A system for improving the robustness of a speech processing system having at least one speech processing module, the system comprising an input for receiving an input sound signal comprising audio and non-audio frequencies; and a filter for separating a non-audio band component from the input sound signal, and the system being configured for:

receiving an input sound signal comprising audio and non-audio frequencies;

separating the input sound signal into an audio band component and a non-audio band component;

identifying possible interference within the audio band from the non-audio band component, wherein the step of identifying possible interference within the audio band from the non-audio band component comprises:

comparing the audio band and non-audio band components;

measuring a signal power in the audio band component $P_a$;

measuring a signal power in the non-audio band component $P_b$; and if $(P_a/P_b)$<threshold limit, flagging the quality of the input sound signal as unreliable for speech processing; and adjusting operation of a downstream speech processing module based on said identification, wherein the step of adjusting comprises controlling operation of a downstream speech processing module based on the flagged unreliable quality.

27. A system for improving the robustness of a speech processing system having at least one speech processing module, the system comprising an input for receiving an input sound signal comprising audio and non-audio frequencies; and a filter for separating a non-audio band component from the input sound signal, and the system being configured for:

receiving an input sound signal comprising audio and non-audio frequencies;

separating the input sound signal into an audio band component and a non-audio band component;

identifying possible interference within the audio band from the non-audio band component, wherein the step of identifying possible interference within the audio band from the non-audio band component comprises comparing the audio band and non-audio band components, and wherein the step of comparing comprises:

detecting an envelope of the non-audio band component;

detecting a level of correlation between the envelope of the non-audio band component and the audio band component; and determining possible non-audio band interference within the audio band if the level of correlation exceeds a threshold value; and adjusting operation of a downstream speech processing module based on said identification.

28. A system for improving the robustness of a speech processing system having at least one speech processing module, the system comprising an input for receiving an input sound signal comprising audio and non-audio frequencies; and a filter for separating a non-audio band component from the input sound signal, and the system being configured for:

receiving an input sound signal comprising audio and non-audio frequencies;

separating the input sound signal into an audio band component and a non-audio band component;

identifying possible interference within the audio band from the non-audio band component, wherein the step of identifying possible interference within the audio band from the non-audio band component comprises comparing the audio band and non-audio band components, and wherein the step of comparing comprises:

simulating an effect of a non-linearity on the non-audio band component to provide a simulated non-linear signal;

detecting a level of correlation between the simulated non-linear signal and the audio band component; and determining possible non-audio band interference within the audio band if the level of correlation exceeds a threshold value; and adjusting operation of a downstream speech processing module based on said identification.

29. A system for improving the robustness of a speech processing system having at least one speech processing module, the system comprising an input for receiving an input sound signal comprising audio and non-audio frequencies; and a filter for separating a non-audio band component from the input sound signal, and the system being configured for:

receiving an input sound signal comprising audio and non-audio frequencies;

separating the input sound signal into an audio band component and a non-audio band component;

identifying possible interference within the audio band from the non-audio band component; and adjusting operation of a downstream speech processing module based on said identification, wherein the step of adjusting comprises providing a compensated sound signal to a downstream speech processing module; and wherein the step of providing a compensated sound signal comprises:

subtracting a simulated non-linear signal from the audio band component to provide a compensated output signal; and providing the compensated output signal to a downstream speech processing module.

30. A system for improving the robustness of a speech processing system having at least one speech processing module, the system comprising an input for receiving an input sound signal comprising audio and non-audio frequencies; and a filter for separating a non-audio band component from the input sound signal, and the system being configured for:

receiving an input sound signal comprising audio and non-audio frequencies;

separating the input sound signal into an audio band component and a non-audio band component;

identifying possible interference within the audio band from the non-audio band component, wherein the step of identifying possible interference within the audio band from the non-audio band component comprises comparing the audio band and non-audio band components; and adjusting operation of a downstream speech processing module based on said identification;

wherein the steps of comparing and adjusting comprise:

simulating an effect of a non-linearity on the non-audio band component to provide a simulated non-linear signal;

subtracting the simulated non-linear signal from the audio band component to provide a compensated output signal; and providing the compensated output signal to a downstream speech processing module.

31. A system for improving the robustness of a speech processing system having at least one speech processing module, the system comprising an input for receiving an input sound signal comprising audio and non-audio frequencies; and a filter for separating a non-audio band component from the input sound signal, and the system being configured for:

receiving an input sound signal comprising audio and non-audio frequencies;

separating the input sound signal into an audio band component and a non-audio band component;

identifying possible interference within the audio band from the non-audio band component;

adjusting operation of a downstream speech processing module based on said identification; and measuring a signal power in the non-audio band component $P_b$, wherein the method is responsive to the step of measuring the signal power, such that:

if the measured signal power level $P_b$ is below a threshold level X, the method comprises flagging the input sound signal as free of non-audio band interference, and if the measured signal power level $P_b$ is above a threshold level X, the method performs the step of identifying possible interference within the audio band from the non-audio band component.

32. A non-transitory computer readable storage medium having computer-executable instructions stored thereon that, when executed by processor circuitry, cause the processor circuitry to perform a method according to claim 1.

* * * * *